US006854836B2

(12) United States Patent
Ishinaga et al.

(10) Patent No.: US 6,854,836 B2
(45) Date of Patent: Feb. 15, 2005

(54) LIQUID CONTAINER, LIQUID SUPPLY SYSTEM, LIQUID USING APPARATUS, INK TANK, INK SUPPLY SYSTEM, INKJET PRINT HEAD AND PRINT APPARATUS

(75) Inventors: Hiroyuki Ishinaga, Tokyo (JP); Nobuyuki Kuwabara, Tokyo (JP); Tetsuya Ohashi, Chiba (JP); Ryoji Inoue, Kanagawa (JP); Hideki Ogura, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/263,767

(22) Filed: Oct. 4, 2002

(65) Prior Publication Data

US 2003/0067518 A1 Apr. 10, 2003

(30) Foreign Application Priority Data

Oct. 5, 2001 (JP) ..... 2001-310649
Dec. 27, 2001 (JP) ..... 2001-398219

(51) Int. Cl.[7] ..... B41J 2/175
(52) U.S. Cl. ..... 347/85; 347/87
(58) Field of Search ..... 347/84, 85, 86, 347/87; 101/366; 401/40

(56) References Cited

U.S. PATENT DOCUMENTS 3,720,473 A * 3/1973 Nakata ..... 401/40
4,119,034 A * 10/1978 Wax ..... 101/366
5,040,002 A * 8/1991 Pollacek et al. ..... 347/87
6,213,598 B1 * 4/2001 Hou et al. ..... 347/86
6,345,888 B1 2/2002 Matsumoto et al. ..... 347/86
6,428,152 B1 * 8/2002 Hollands ..... 347/85
6,450,631 B1 9/2002 Hayashi et al. ..... 347/86
6,520,630 B1 * 2/2003 Oda et al. ..... 347/85
6,575,567 B2 6/2003 Matsumoto et al. ..... 347/85
2003/0035036 A1 2/2003 Ogura et al. ..... 347/86
2003/0067520 A1 4/2003 Inoue et al. ..... 347/86

FOREIGN PATENT DOCUMENTS

JP 7-125240 5/1995
JP 7-125241 5/1995

* cited by examiner

*Primary Examiner*—Anh T.N. Vo
(74) *Attorney, Agent, or Firm*—Fitzpatrick, Cella, Harper & Scinto

(57) ABSTRACT

The present invention prevents liquid leakage regardless of the using conditions and the reserving atmosphere and stabilizes a negative pressure regardless of the degree of liquid consumption, by having a one-way valve in the liquid container that supplies liquid to an external device, maintaining the negative pressure formed in the liquid supplying passage positioned in the downstream of a position where liquid or gas is supplied by the one-way valve. The liquid container has a deformable, movable unit at least a part of which is made of a flexible material. A space other than the liquid supply unit forms a substantially sealed space in which liquid is retained. The container is capable of supplying the liquid to the outside. Such container has a one-way valve that passes liquid or gas from the liquid container to the outside or from the outside to the liquid container.

6 Claims, 18 Drawing Sheets

LIQUID CONTAINER, LIQUID SUPPLY SYSTEM, LIQUID USING APPARATUS, INK TANK, INK SUPPLY SYSTEM, INKJET PRINT HEAD AND PRINT APPARATUS

This application is based on Japanese Patent Application Nos. 2001-310649 filed Oct. 5, 2001 and 2001-398219 filed Dec. 27, 2001, the contents of which are incorporated hereinto by reference.

BACKGROUND OF THE INVENTION

1. Field of the Invention

The invention relates to a liquid container that supplies liquids such as ink to a liquid using unit of a recording unit such as a pen and a print head; a liquid supply system that is the combination of such a liquid container and liquid using unit; and a liquid using apparatus employing such a liquid supply system, an ink tank, an ink supply system, inkjet print head and a print apparatus employing such an ink supply system.

2. Description of the Related Art

Some of the liquid using apparatuses, such as an inkjet print apparatus that forms images on a printing medium by applying a liquid ink thereon using an inkjet print head, form images on a printing medium by moving a print head thereover and ejecting ink thereto. Others may form images by moving, in turn, a printing medium over a fixed print head that ejects ink thereto.

One of the methods for supplying ink to the print head of such an inkjet print apparatus is called the on-carriage method in which an ink tank installed, inseparably or separably, in the print head that is mounted on a carriage and the like and shuttles (scans) supplies ink. Meanwhile, there is another-method called the tube method in which an ink tank, separate from the print head mounted on the carriage, is fixed on another unit of the print apparatus and the ink is supplied from the ink tank to the print head via a flexible tube. In the methods, there is included such a method. In which a second ink tank serving as an intermediate tank between the ink tank and the print head is mounted on the print head or the carriage.

In the prior art of the ink tank from which the ink is supplied directly to the print head, there is the one that has a deformable, flexible, sealed, bag-shaped member which holds ink and a spring member which generates a negative pressure in the bag-shaped member by applying a force to expand the deformable portion. This negative pressure lies in a pressure range for the print head to enable to eject ink in equilibrium with ability for holding meniscus formed at an ink ejection port of the print head.

In such an ink tank of this mechanism, however, the force exerted by the spring increases as the ink decreases during ink consumption. Then the negative pressure inside the bag-shaped member grows and eventually exceeds the negative pressure limit below which the print head can eject ink. As a result, a problem arises that the ink tank becomes useless before all the ink in it has been consumed.

There are ink tanks of another type that hold ink in a bag-shaped member of which a material and shape is properly selected so that the bag-shaped member itself generates a negative pressure. Although such an ink tank becomes flat leaving no space in it when ink has been completely consumed, there is a limit to the shape of such a bag-shaped member. Thus when one tries to fit such an ink tank in the housing, the bag-shaped member filled with ink does not fit well in the housing, leaving dead space in the ink tank. In addition, since the negative pressure grows also in such a bag-shaped member as the ink is running out, there arise problems that the ability to supply ink to the print head may decrease and ejecting operation of the print head may become unstable.

Meanwhile, Japanese Patent Application Laid-Open Nos. 7-125240 (1995) and 7-125241 (1995) disclose an ink tank that has a mechanism to introduce air into the flexible container as the internal negative pressure grows, so that the negative pressure can be kept in the proper range. It is proposed that a generally tubular orifice made of a ball and a boss is formed. In this structure, a tubular boss leading from the outside into the container is formed and the ball of which outer diameter is smaller than the inner diameter of the boss is located in a plurality of projecting ribs formed in the inner wall of the boss. Such an orifice has a size such that a small amount of ink serves as a liquid seal due to capillary action of the ink. And its shape is selected so that the negative pressure inside the container overcomes the capillary action of ink and the liquid seal of the ink becomes inactive as the negative pressure approaches the limit level of the print head for normal operation. Specifically, the container introduces air thereinto to decrease the negative pressure, so that the print head may continue normal operation.

The above structure provides a sealed system held by the balance between the ability for holding meniscus formed at a tubular orifice (a liquid seal) and the negative pressure applied by the spring. Although the mechanism itself is relatively simple, the structure has the following problems. Namely, because of pressure difference between the outside and the inside of the container, decrease in the ink viscosity due to increased temperatures, shock and fall of the ink tank during handling, particularly in the serial printing, acceleration applied during scanning and other factors, the liquid seal is broken and the ink leaks out. In addition, since the liquid seal is rather affected by humidity changes including drying up, air may not be smoothly introduced into the tank. Then the ink supply ability to the print head is affected and printing quality deteriorates accordingly.

To avoid such problems, the above Patent Application Laid-Open Publications disclose a structure in which an inlet maze that works as an overflow container is communicated with the boss and thereby ensures the humidity gradient. However, the structure becomes complex.

There is another concern that air rushes into the container when the ink held in the container is running out. Then the ink left in the print head may leak out from the ejection port and the tubular orifice where the meniscus has not formed.

Furthermore, the dimensions of the boss and the ball, in other words, the size of the orifice, should be designed based on the physical properties of ink, such as ink viscosity, container size and other factors. Thus each time there is a change to such factors, the orifice design must be modified accordingly.

The present invention has been made to solve the above problems, and one of its aspects is to prevent liquid leakage regardless of the using conditions and the reserving atmosphere and stabilize the container negative pressure characteristic regardless of the degree of liquid consumption, by having a one-way valve in the liquid container (ink tank) that supplies liquids such as ink to an external device such as a print head, maintaining the negative pressure formed in the liquid supplying passage positioned in the downstream of a position where a fluid is supplied by the one-way valve.

SUMMARY OF THE INVENTION

To solve the above problems, the liquid container of the present invention has a deformable, movable unit at least a part of which is made of a flexible material and a liquid supply unit for supplying liquid to the outside. A space other than the liquid supply unit forms a substantially sealed space in which liquid is retained. The liquid supply unit has a one-way valve for controlling a liquid supply which allows liquid to go out from the sealed space but does not allow liquid or gas to enter the sealed space while supplying liquid from the sealed space to the outside.

Preferably, the center of the movable unit has a convex shape projecting toward the outside of the sealed space. The one-way valve for controlling a liquid supply may be detachable from the liquid supply unit.

The one-way valve for controlling a liquid supply supplies liquid to the outside from the sealed space when the pressure difference between the sealed space and the outside exceeds a predetermined value.

A liquid supply system of the present invention has the liquid container and a liquid using apparatus, and liquid is sent to the liquid using apparatus via the one-way valve for controlling a liquid supply when supplying the liquid retained in the sealed space to the liquid using apparatus.

The liquid using apparatus has a joint, and the joint can be attached to and detached from the one-way valve for controlling a liquid supply integrated with the liquid supply unit.

The liquid container of the present invention has a deformable, movable unit at least a part of which is made of a flexible material, a liquid supply unit for supplying liquid to the outside and a gas introduction unit introducing gas from the outside. A space other than the liquid supply unit and the gas introduction unit forms a substantially sealed space in which liquid is retained. The gas introduction unit may have a one-way valve for controlling a liquid supply which allows gas to enter the sealed space from the outside but does not allow liquid or gas to go out from the sealed space to the outside while supplying liquid from the sealed space to the outside.

The liquid supply system of the present invention has the liquid container and a liquid using apparatus, and gas is sent to the sealed space from the outside via the one-way valve for controlling a liquid supply when supplying the liquid retained in the sealed space to the liquid using apparatus.

The liquid container of the present invention has a deformable, movable unit at least a part of which is made of a flexible material, a liquid supply unit for supplying liquid to the outside and a gas introduction unit introducing gas from the outside. A space other than the liquid supply unit and the gas introduction unit forms a substantially sealed space in which liquid is retained. The liquid supply unit may have a one-way valve for controlling a liquid supply which allows liquid to go out from the sealed space but does not allow liquid or gas to enter the sealed space while supplying liquid from the sealed space to the outside, and the gas introduction unit may have a one-way valve for controlling a liquid supply which allows gas to enter the sealed space from the outside but does not allow liquid or gas to go out from the sealed space to the outside while supplying liquid from the sealed space to the outside.

In the present invention, the liquid container retaining liquid is an ink tank; the liquid using apparatus is an inkjet print head that is connected to the ink tank and ejects ink supplied from the sealed space of the ink tank from the ink ejection port for printing. The present invention is a print apparatus that conducts printing on a printing medium using the inkjet print head.

The above and other objects, effects, features and advantages of the present invention will become more apparent from the following description of embodiments thereof taken in conjunction with the accompanying drawings.

DETAILED DESCRIPTION OF PREFERRED EMBODIMENTS

In this specification, the wording "printing" means not only a condition of forming significant information such as characters and drawings, but also a condition of forming images, designs, patterns and the like on printing medium widely or a condition of processing the printing media, regardless of significance or unmeaning or of being actualized in such manner that a man can be perceptive through visual perception.

The wording "printing media" means not only a paper used in a conventional printing apparatus but also everything capable of accepting inks, such as fabrics, plastic films, metal plates, glasses, ceramics, wood and leathers, and in the following, will be also represented by a "sheet" or simply by "paper".

The wording "ink" also should be interpreted in a broad sense as well as a definition of the above "printing" and thus the ink, by being applied on the printing media, shall mean a liquid to be used for forming images, designs, patterns and the like, processing the printing medium or processing inks (for example, coagulation or encapsulation of coloring materials in the inks to be applied to the printing media).

Now the embodiments of the present invention will be described below with reference to the accompanying drawings.

(First Embodiment)

Figure 1:
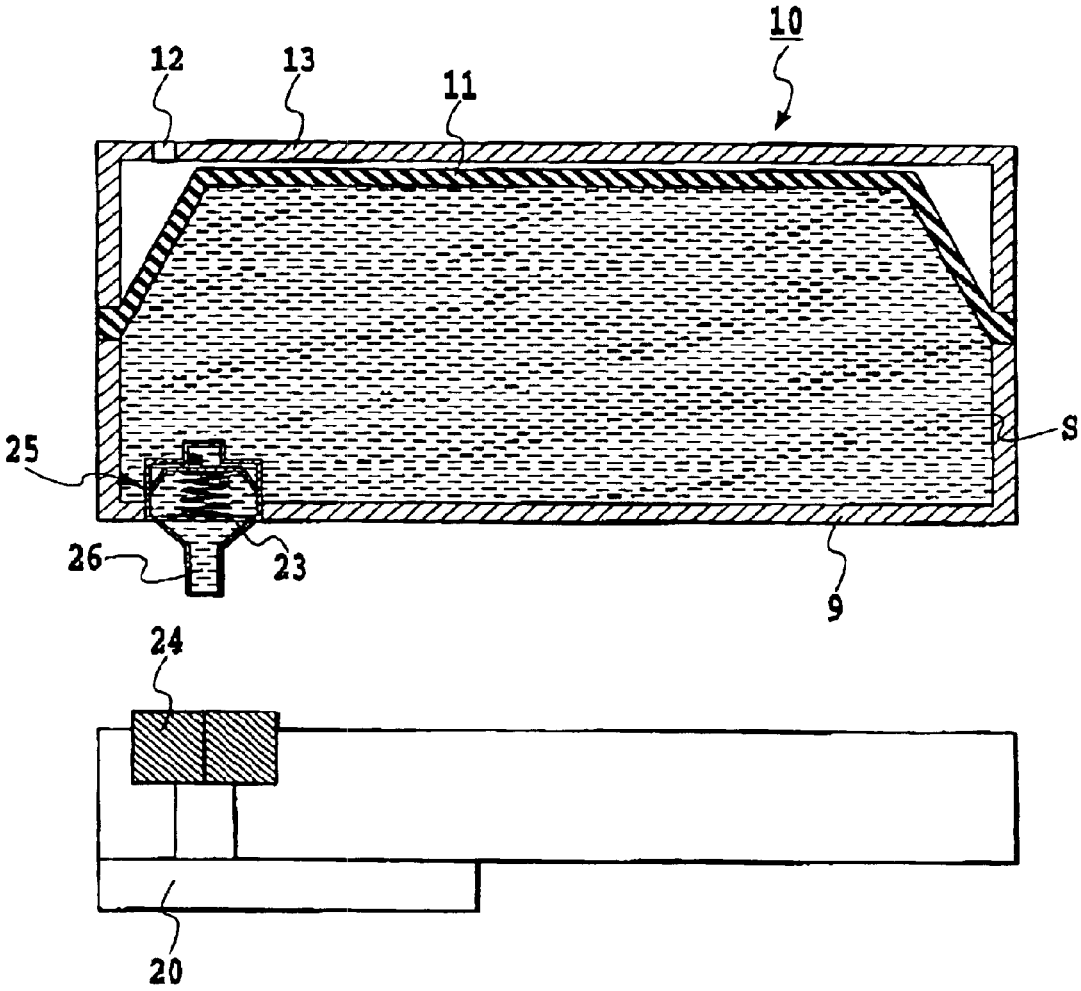
FIG. 1 is a schematic sectional view of the ink tank and the print head being one embodiment of the liquid supply system according to the present invention.

FIG. 1 shows a first embodiment of the liquid supply system according to the invention having a liquid container integrated with a one-way valve for controlling a liquid supply.

Referring now to FIG. 1, denoted 10 is an ink tank (also called an ink cartridge) that is a cartridge-type liquid container capable of retaining ink, and 20 is an inkjet print head working as the liquid using unit that can eject ink supplied from the ink tank 10. Although the ways of ink ejection from the inkjet print head 20 are not specified here, thermal energy generated by a thermoelectric converter may be used as the energy for ejecting ink, for example. In such a case, the heat generated by the thermoelectric converter produces film boiling from the ink and the energy of generated bubbles allows ink to be ejected out of the ink ejection port. If the ink tank 10 and the inkjet print head 20 in this embodiment are separably coupled with each other, a detachable inkjet cartridge can be prepared for the inkjet print apparatus. Then it is possible to selectively replace the cartridge-type ink tank 10, the inkjet print head 20, or the whole inkjet cartridge.

In the ink tank 10, the housing 9 and a movable unit 11 form an ink containing space S (also called liquid containing chamber). The space over the movable unit 11 in the ink tank 10 is communicated with the outside air through an air-through hole 12 and thus equal to atmospheric pressure. The outer wall 13 of the ink tank 10 works as a shell that protects the movable unit 11 from external forces. The movable unit 11 of the present embodiment is made of a deformable, flexible film (sheet member: FIG. 1 schematically illustrating the ink tank of the present invention depicts the movable unit 11 being as thick as the outer wall 13. The real movable unit 11, however, has a very flexible, thin film structure. The structure of the movable unit 11 referred to in the following embodiments is equal to this structure.) The center of this movable unit 11 is convex, and its side view is preferably a trapezoid shape. As described later, the movable unit 11 should have a slack so as to deform according to the ink level and fluctuations of the pressure in the ink containing space S. In such a case, it is preferable that the periphery of the movable unit 11 extends and contracts in a balanced manner and deforms uniformly and thereby the center of the movable unit 11 moves in the vertical direction keeping its center flat. When the movable unit 11 deforms or moves smoothly, there is no occurrence of a shock associated with deformation or irregular pressure fluctuations caused by shocks in the containing space S.

A one-way valve unit 25, which controls to deliver or supply the liquid retained in the containing space S to the outside, is integrated with the liquid delivery unit (also called the liquid supply unit) in the bottom of the ink tank 10. Thus the ink containing space S except the one-way valve unit 25 forms a substantially sealed space.

On the side of the print head 20 is formed a joint 24 which can mate the one-way valve unit 25. This joint 24 is capped with a rubber lid so as to seal the ink passage in the print head 20 substantially air-tight utilizing the resilience of the rubber. The structure of the joint 24 is not limited to the above example; the joint 24 may take various structures that can stably catch and release the one-way valve unit.

Figure 3A:
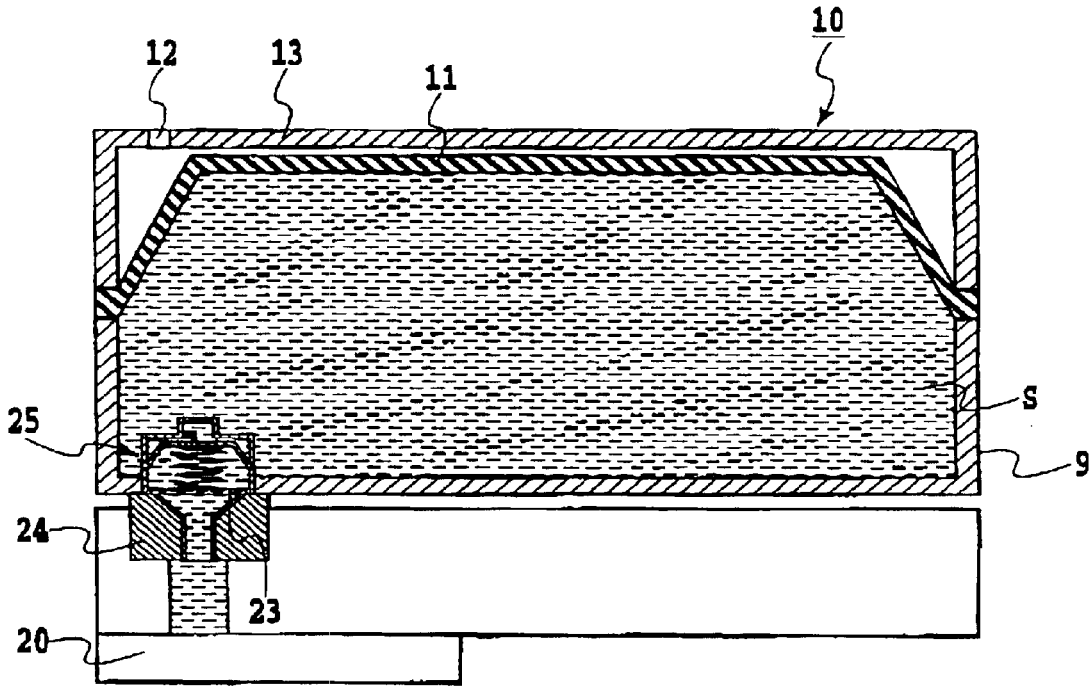
FIGS. 3A and 3B are diagrams illustrating how the ink in the ink tank is supplied to the external device in the embodiment of FIG. 1.
Figure 3B:
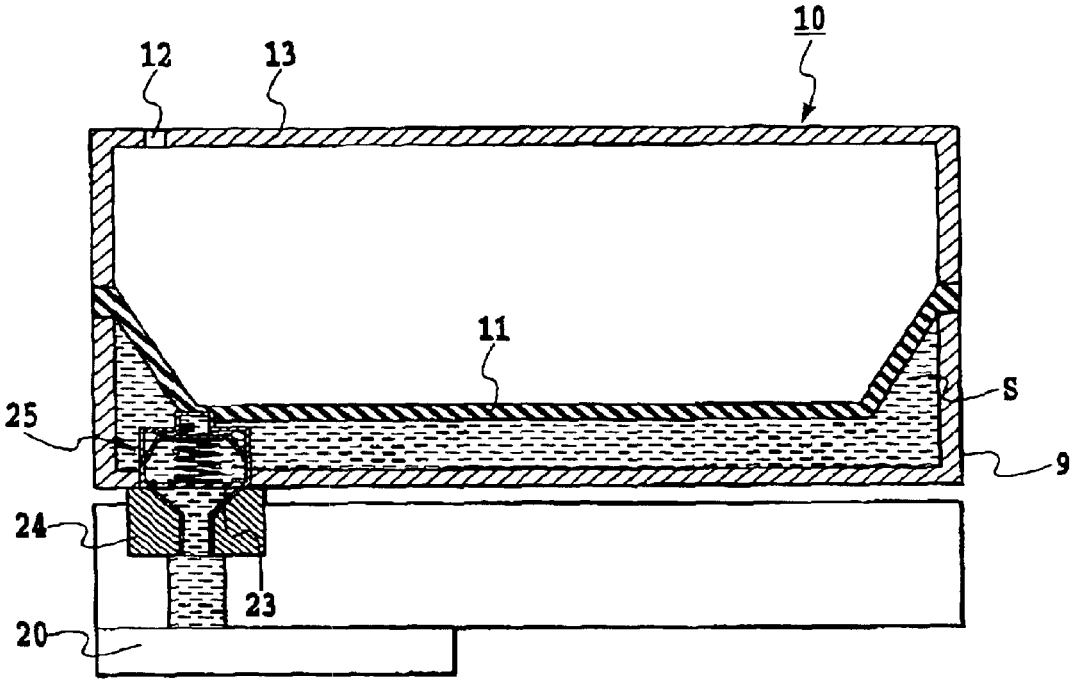

As shown in FIGS. 3A and 3B, the liquid in the ink tank 10 is supplied to the print head 20 when a hollow needle 26 extending downward from the one-way valve unit 25 is inserted in the joint 24. The one-way valve unit 25 works as a passage to supply the liquid retained in the container to the print head 20 and controls the liquid supply with a diaphragm valve installed therein.

Figure 2A:
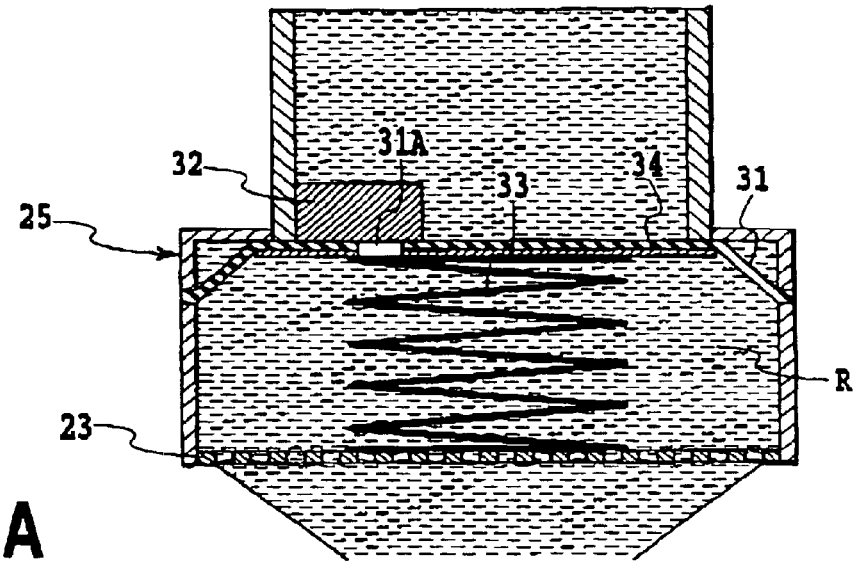
FIGS. 2A and 2B are sectional views illustrating the operation of the one-way valve unit of the embodiment of FIG. 1.
Figure 2B:
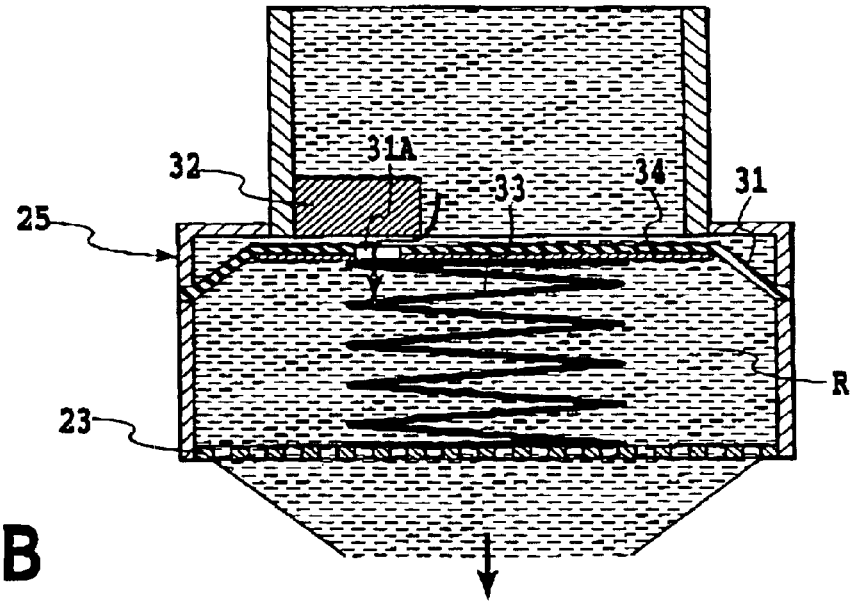

FIGS. 2A and 2B illustrate an example of the specific structure of the one-way valve unit 25.

The one-way valve unit 25 of the present embodiment includes a diaphragm valve using a movable diaphragm 31 made of flexible materials. The diaphragm 31 has an opening 31A in a position facing a seal unit 32 arranged in a predetermined position. A spring 33 constantly applies an upward force to the diaphragm 31 in FIGS. 2A and 2B. As shown in FIG. 2A, since the opening 31A is depressed on the seal unit 32, the opening 31A is closed and then the supply of liquid is blocked. Denoted 34 is a pressure plate closely contacting the diaphragm 31, applying the resilient force of the spring 33 to the entire diaphragm 31.

As described above, the hollow needle 26 is inserted in the print head 20 through the rubber lid of the joint 31. Then the valve room R is communicated with the print head 20 through the hollow needle 26, and as a result the pressure inside the valve room R becomes equal to that inside the print head 20. There is a mechanism by which the liquid is supplied to the inkjet print head 20 via a filter 23.

Figure 16:
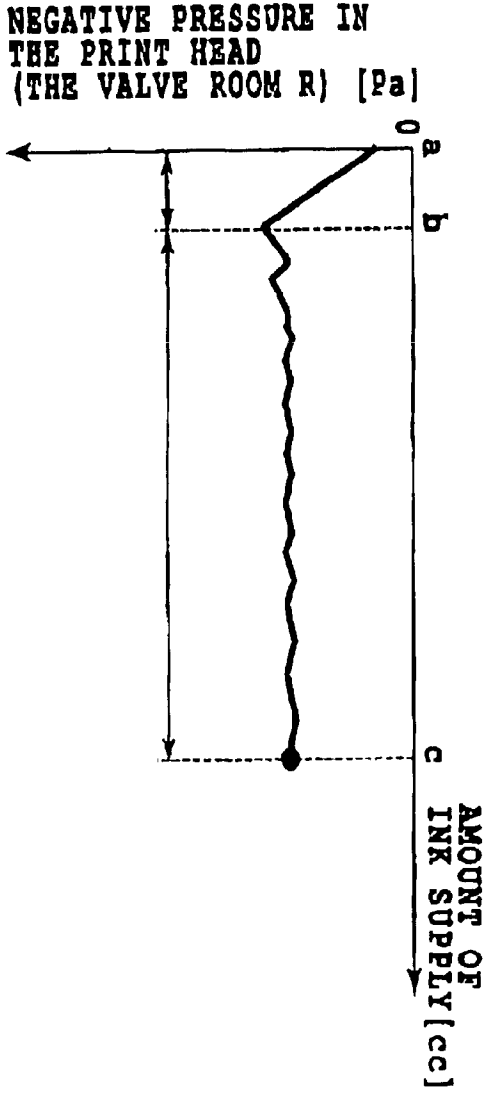
FIG. 16 is a graph illustrating the negative pressure applied to the inkjet print head.

When liquid goes out from the print head 20, the volume of the ink supply passage in the downstream of the diaphragm 31 including the valve room R decreases, and there appears a negative pressure that produces a force to pull the diaphragm 31 away from the seal unit 32. In other words, the pressure on the head side becomes smaller than that on the side of the liquid container 10 across the valve. However, because the resilient force of the spring unit 33 restricts the movement of the diaphragm, the negative pressure grows (see a-b region in FIG. 16). When ink continues to go out from the print head 20 and the resulting pressure difference exceeds a predetermined value, the diaphragm 31 and the pressure plate 34 subject to such a negative pressure push the spring 33 to pull the diaphragm 31 away from the seal unit 32 (see point b in FIG. 16). At this moment, as shown in FIG. 2B, the liquid on the liquid container 10 side flows into the valve room R through the opening 31A. Then the ink volume in the ink supply passage in the downstream of the diaphragm 31 including the valve room R increases, and the negative pressure decreases. As a result, the diaphragm 31 is again depressed to the seal unit 32 to return to the original state of FIG. 2A. As shown in FIG. 16, the negative pressure in the ink supply passage in the downstream of the diaphragm 31 including the valve room R is thereby maintained at an almost constant level (see b-c region of FIG. 16), and ink can be supplied to the print head 20 stably. In turn, when generated bubbles and changes in the ambient condition augment the pressure inside the valve room R and the pressure turns to be positive, the force pushing the opening 31A onto the seal unit 32 increases. Thus there is no ink movement to the ink tank or reverse ink flow.

FIGS. 3A and 3B illustrate how the liquid in the ink tank 10 is sent out; FIG. 3A shows the initial state; and FIG. 3B shows the state in which almost all the ink has gone out. In other words, FIG. 3A illustrates the state in which a small amount of ink has been consumed since the initial fill-up state of the containing space S. FIG. 3B illustrates the state in which the movable unit 11 has moved downward as the ink is consumed. FIG. 3B shows the lowermost displacement of the movable unit 11. It is preferable to make the movable unit 11 from a very flexible material so that almost no negative pressure is generated in the container 10.

Figure 4A:
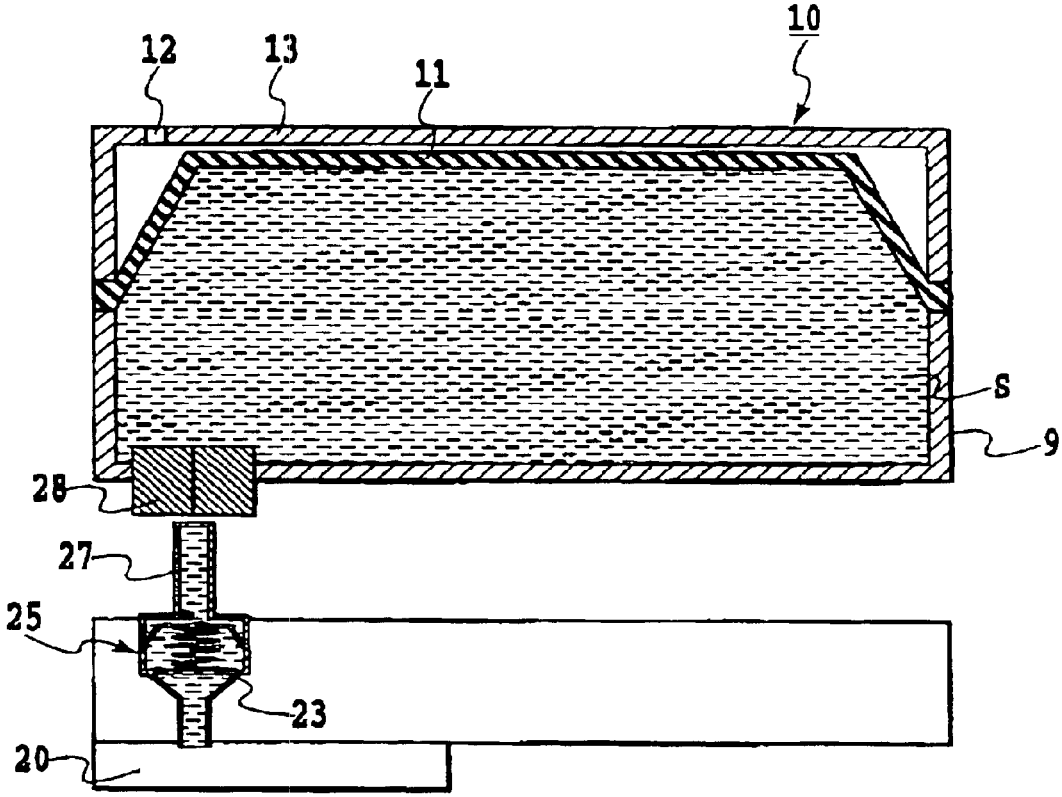
FIGS. 4A and 4B are schematic sectional views illustrating a variation of the embodiment of FIG. 1.
Figure 4B:
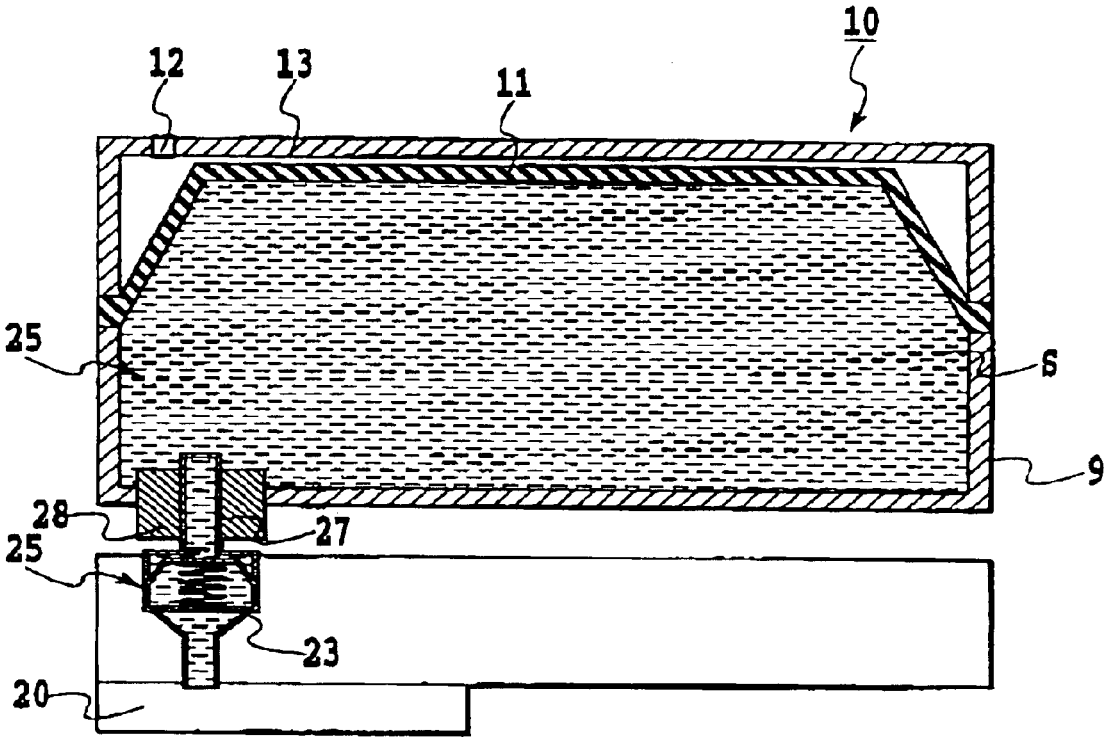

The present embodiment describes the structure in which the one-way valve unit 25 is integrated with the ink tank 10 serving as the liquid container. However, the structure is not limited to this example. For instance, as shown in FIGS. 4A and 4B, the one-way valve unit 25 may be integrated with the inkjet print head 20 serving as the liquid using apparatus. In such a case, as shown in FIGS. 4A and 4B, the ink tank 10 has a rubber lid 28 in its bottom, while the inkjet print head 20 has a one-way valve unit 25 equipped with a hollow needle 27 extending upward to pass through the rubber lid 28. In this embodiment, because the part that will be replaced when ink has run out is only the liquid container 10, the running cost for printing can be reduced. Furthermore, according to this configuration, the one-way valve unit 25 exerts a negative pressure onto the head nozzle even when the container 10 is separated from the head 20. Thus there is no ink leakage from the nozzle.

In addition, the liquid container 10 of the present invention has a sealed structure but does not need to generate negative pressure by itself. Thus its design flexibility, durability and reliability required during distribution and storage are high.

(Second Embodiment)

FIGS. 5–8 are the drawings that illustrate a second embodiment of the present invention.

Figure 5:
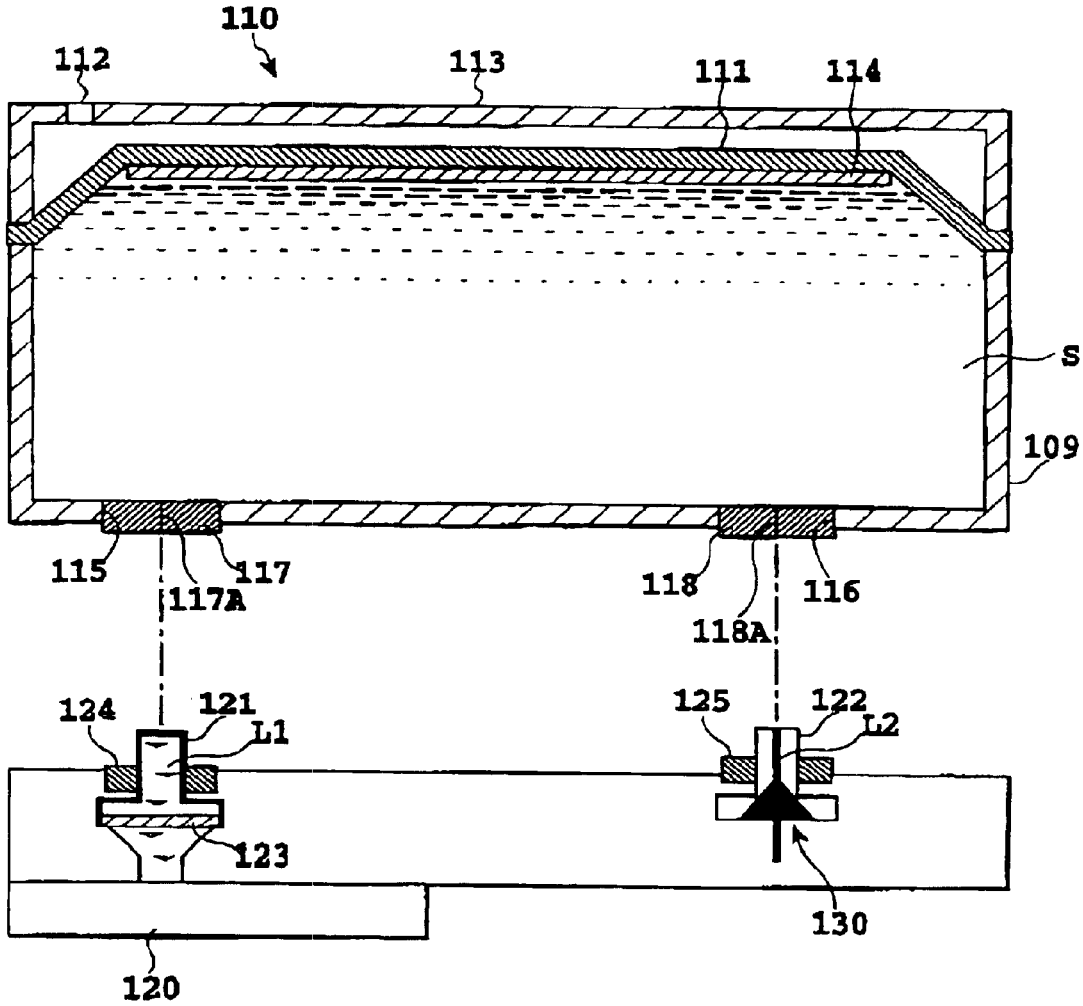
FIG. 5 is a schematic sectional view of the ink tank and the print head of a second embodiment of the present invention.

As shown in FIG. 5, the basic structure of the liquid supply system according to the second embodiment is the same as that of the first embodiment. In FIG. 5, denoted 110 is a cartridge-type ink tank (or ink cartridge) that can hold ink, and 120 is a print head that can eject ink supplied from the ink tank 110. The mode of ink ejection in the print head 120 is not specified, as is the case with the first embodiment. For example, thermal energy generated by a thermoelectric converter may be used as the energy for ejecting ink. In such a case, the heat generated by the thermoelectric converter produces film boiling from the ink and the energy of evolving bubbles allows ink to be ejected out of the ink ejection port. If the ink tank 110 and the print head 120 are separably coupled with each other, a detachable inkjet cartridge can be prepared for the inkjet print apparatus. Then it is possible to selectively replace the cartridge-type ink tank 110 or the print head 120, or even the whole inkjet cartridge.

Inside the ink tank 110, an ink containing space S is formed by a housing 109 and a movable unit 111. The space over the movable unit 111 in the ink tank 110 is open to the outside air through an air-through hole 112 and thus equal to atmospheric pressure. The outer wall 113 of the ink tank 110 works as a shell that protects the movable unit 111 from external forces. The movable unit 111 of the present embodiment is made of a deformable, flexible film (sheet). The center part of this movable unit 111 is restricted its shape by a plate 114, and its periphery is deformable. The center of the movable unit 111 is convex, and its side shape is trapezoid. As described later, the movable unit 111 deforms according to the ink level and pressure changes in the containing space S. In such a case, the periphery of the movable unit 111 extends and contracts in a balanced manner and deforms uniformly and thereby the center of the movable unit 111 moves in the vertical direction keeping its center flat. When the movable unit 111 deforms or moves smoothly, there is no occurrence of a shock associated with deformation or irregular pressure fluctuations caused by shocks in the containing space S.

In this embodiment, an ink supply opening 115 working as the liquid delivery unit (liquid supply unit) and a communicating opening 116 working as the gas (or liquid) introduction unit are formed in the bottom of the ink tank 110. Each of the openings 115, 116 is closed respectively by rubber plugs 117, 118 serving as a joint unit. Thus the ink containing space S except for the ink supply opening 115 and the communicating opening 116 forms a substantially sealed space. The movable unit 111 of the present embodiment can be used when there is not a movable space much enough to supply almost all the ink in the containing space S to the outside.

The print head 120 has hollow needles 121, 122 that will penetrate the rubber plugs 117, 118, respectively. The hollow needle 121 penetrates the rubber plug 117 and thereby forms an ink supply passage L1 where ink in the containing space S is supplied to the print head 120. The ink supply passage L1 has a filter 123 therein. Denoted 124 is a seal unit made of, for example, rubber that closely contacts the rubber plug 117. The other hollow needle 122 that will penetrate the rubber plug 118 has a communicating passage L2 through which air can be introduced to the containing space S. The communicating passage L2 has a one-way valve 130 of which structure is schematically described in FIG. 5. Denoted 125 is a seal unit made of, for example, rubber that closely contacts the rubber plug 118. Slits 117A and 118A can be formed in advance in the rubber plugs 117, 118 so as to make it easy for the hollow needles 121, 122 to penetrate the rubber plugs. The slits 117A, 118A are closed by the resilience of the rubber plugs 117, 118 when the hollow needles 121, 122 do not penetrate the plugs.

Figure 6A:
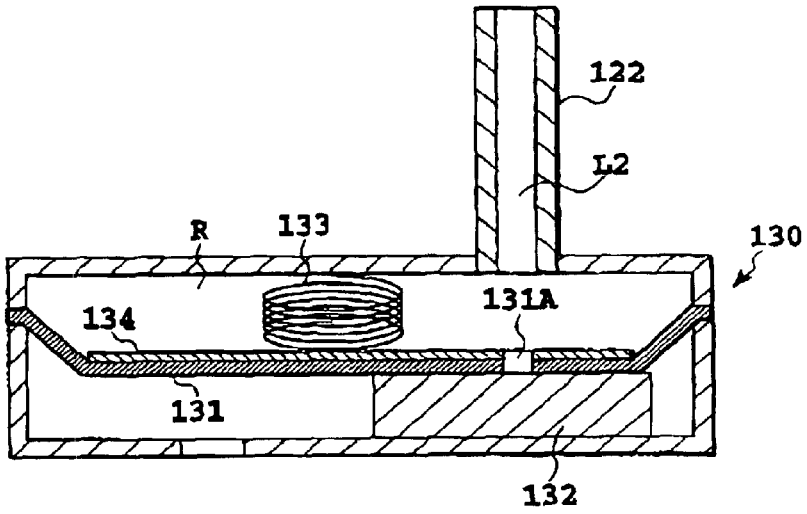
FIGS. 6A and 6B are sectional views illustrating the operation of the one-way valve unit of the embodiment of FIG. 5.
Figure 6B:
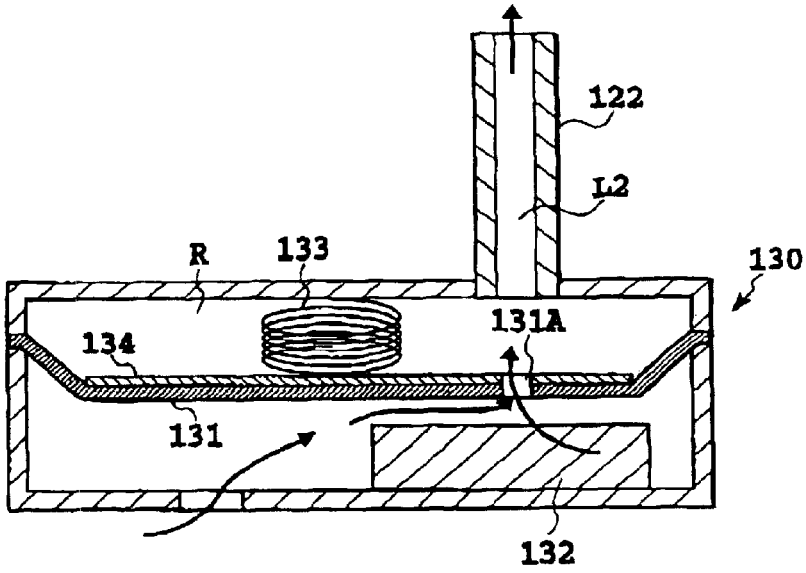

FIGS. 6A and 6B are diagrams illustrating an example of the specific structure of the one-way valve 130.

The one-way valve unit 130 of the present embodiment includes a diaphragm valve using a diaphragm 131. Specifically, the diaphragm 131 has an opening 131A formed in the position opposite to a seal unit 132 arranged in a predetermined position. A spring 133 constantly applies a downward force to the diaphragm 131 in FIGS. 6A and 6B. As shown in FIG. 6A, since the opening 131A is pushed onto the seal unit 132, the opening 131A is closed and then the communicating passage L2 between the valve room R and the outside air is shut. Denoted 134 is a pressure plate closely contacting the diaphragm 131. The valve room R is communicated with the ink tank 110 through the hollow needle 122, and thereby pressure in the valve room R equals to pressure in the containing space S.

When ink is supplied from the ink tank 110 to the print head 120 and the amount of ink in the containing space S decreases, the pressure inside the containing space S falls accordingly. When the pressure in the containing space S becomes below a predetermined value, the opening 131A opens as shown in FIG. 6B. Specifically, the negative pressure in the valve room R increases as the pressure in the containing space S decreases. When the negative pressure has reached a predetermined value, the diaphragm 131 and the plate 134 are driven toward the valve room R, by the pressure difference between the valve room R and the outside, resisting the resilience of the spring 133. As a result, the opening 131A moves off the seal unit 132, and the opening 131A opens to introduce outside air, of which pressure is higher than pressure of the valve room R, into the valve room R. This introduction of outside air relaxes the pressures in the valve room R and the containing space S to predetermined levels, and the opening 131A is closed again by the resilience of the spring 133. When a change in the ambient condition cause a gas expansion to augment the pressure inside the valve room R and the pressure turns to be positive, the force pushing the opening 131A onto the seal 132 increases. Thus there is no ink leakage from the ink tank.

By virtue of the open/close function of the one-way valve 130, the valve room R and the ink containing space S are kept under a constant pressure.

Figure 7A:
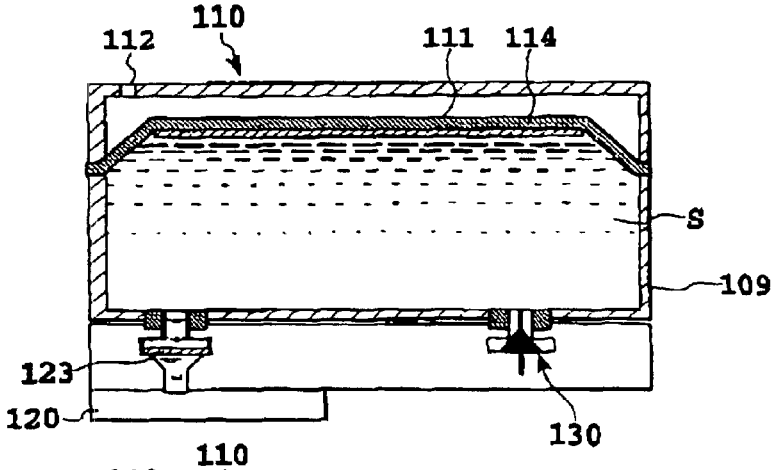
FIGS. 7A to 7C are diagrams illustrating how the ink in the ink tank is supplied to the external device in the embodiment of FIG. 5.
Figure 7B:
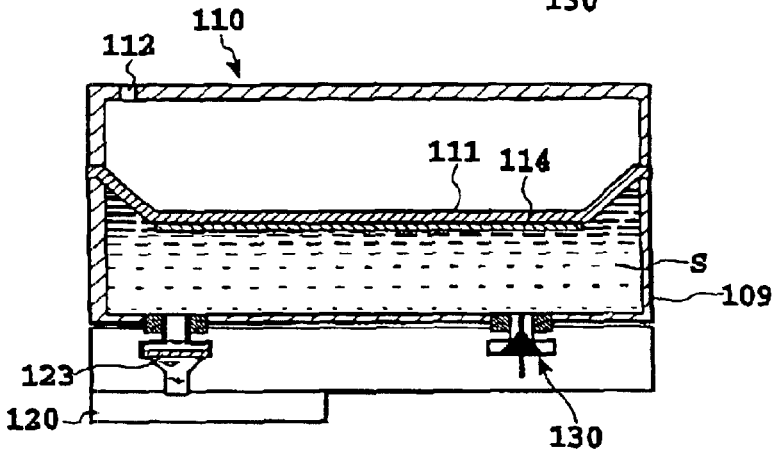
Figure 7C:
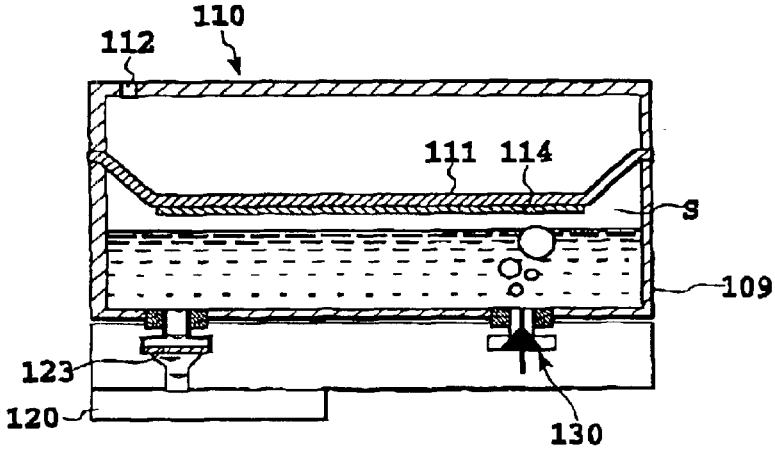

FIGS. 7A to 7C are the diagrams illustrating how the ink tank 110 coupled with the print head 120 works to supply ink.

FIG. 7A illustrates the state in which a small amount of ink has been consumed since the initial fill-up state of the containing space S. FIG. 7B illustrates the state in which the movable unit 111 has moved downward as the ink is consumed. FIG. 7B shows the lowermost displacement of the movable unit 111. As ink is further consumed, the flexible film of the movable unit 111 receives a tension and a negative pressure arises in the containing space S. When the negative pressure in the containing space S exceeds a predetermined level for air introduction, the one-way valve unit 130 opens as described above and then outside air is introduced into the containing space S, as shown in FIG. 7C. Thus the pressure in the containing space S does not decrease below the predetermined level, and the negative pressure of the containing space S disappears. As a result, ink is stably supplied to the print head 120 and the desired printing is carried out.

Figure 8:
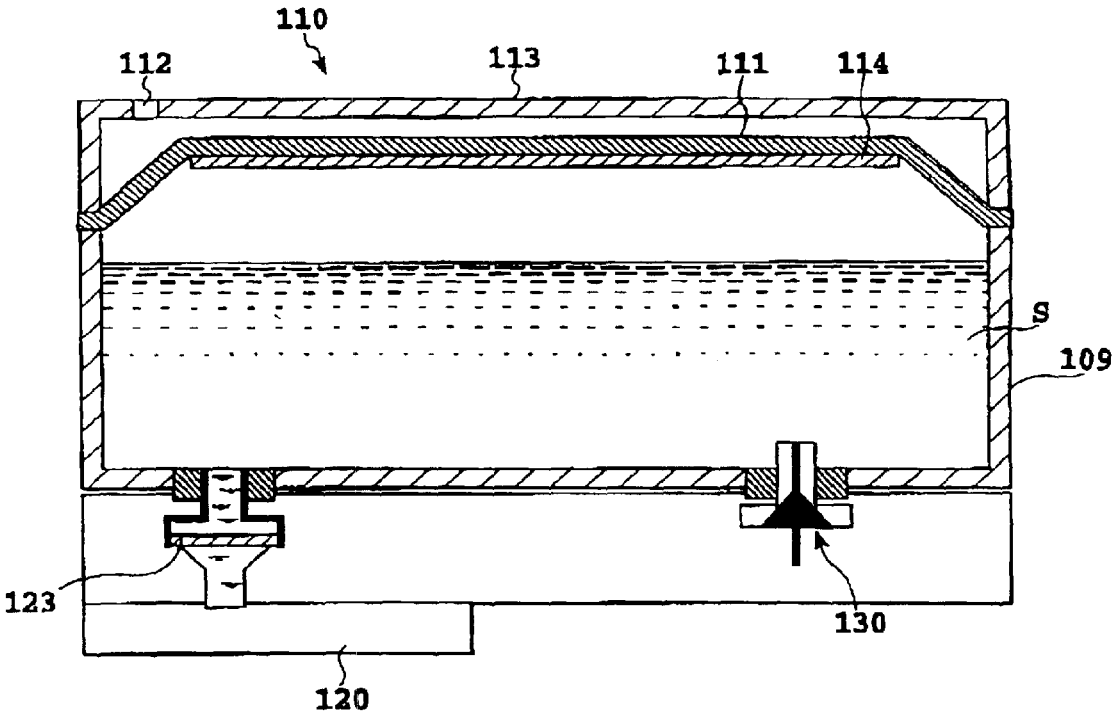
FIG. 8 is a sectional view illustrating the operation of the ink tank of FIG. 5.

When the air staying inside the containing space S expands due to a decrease in ambient pressure and an increase in ambient temperature, the movable unit 111 moves upward as shown in FIG. 8. In other words, the movable unit 111 moves upward according to the expansion of air in the containing space S to cancel the volume change of air. As a result, no pressure difference arises between the inside of the containing space S and the atmosphere, and the pressure inside the containing space S is ensured to stay at a constant level. Then ink can be stably supplied to the print head 120 to perform desired printing operations. Meanwhile, as shown in FIG. 8, should the air in the containing space S expand for an unusual reason and the pressure turn to be positive, the one-way valve unit 130 remains closed and thus the ink does not leak from the ink tank 110.

In this way, the ink level in the ink tank 110 falls corresponding to the amount of ink consumption (amount of ink supply) since air is introduced into the ink tank 110 through the one-way valve unit 130. Then it is possible to take out almost all the ink retained in the ink tank 110 through the ink supply opening 115. Furthermore, since the one-way valve unit 130 prevents ink leakage from the ink tank 110, the ink retained in the ink tank 110 does not leak out through the communicating opening 116 regardless of the attitude of the ink tank 110 during use. Thus there is no limit to the attitude of the ink tank 110 during use.

The structure of the one-way valve unit 130 is not limited to the diaphragm type of the present embodiment. For example, the common check valve, where a valve element is pushed by an urging force of a spring onto the valve seat, and other types of structure may be used. Namely, the one-way valve unit 130 may be of any type if it can block the ink (liquid) leakage from the ink tank 10 and permit air (gas) and ink (liquid) to introduce into the ink tank 10 from the outside. If ink exists outside the one-way valve unit 130 (for example, under the diaphragm 131 of FIGS. 6A and 6B), the one-way valve unit 130 works to allow the external ink to flow in the ink tank 110.

The position of the communicating opening 116 of the ink tank 110 is not limited to the bottom of the ink tank 110. For example, it may be formed in the top or side of the ink tank 110 where the air introduced into the containing space S exists.

As understood in the above description, the structure of the one-way valve unit 130 of the present embodiment is very similar to that of the one-way valve unit 25 of the first embodiment. The difference is that the one-way valve unit 130 of this embodiment is configured to introduce air from the outside to the ink tank 110 while the one-way valve unit 25 of the first embodiment supplies ink from the ink tank 10 to the outside (print head 20). However, it is common that they maintain the pressure in the ink supply passage in the downstream of the one-way valves unit 25, 130 to the print heads 20, 120 at a predetermined value (negative pressure).

(Third Embodiment)

Figure 9:
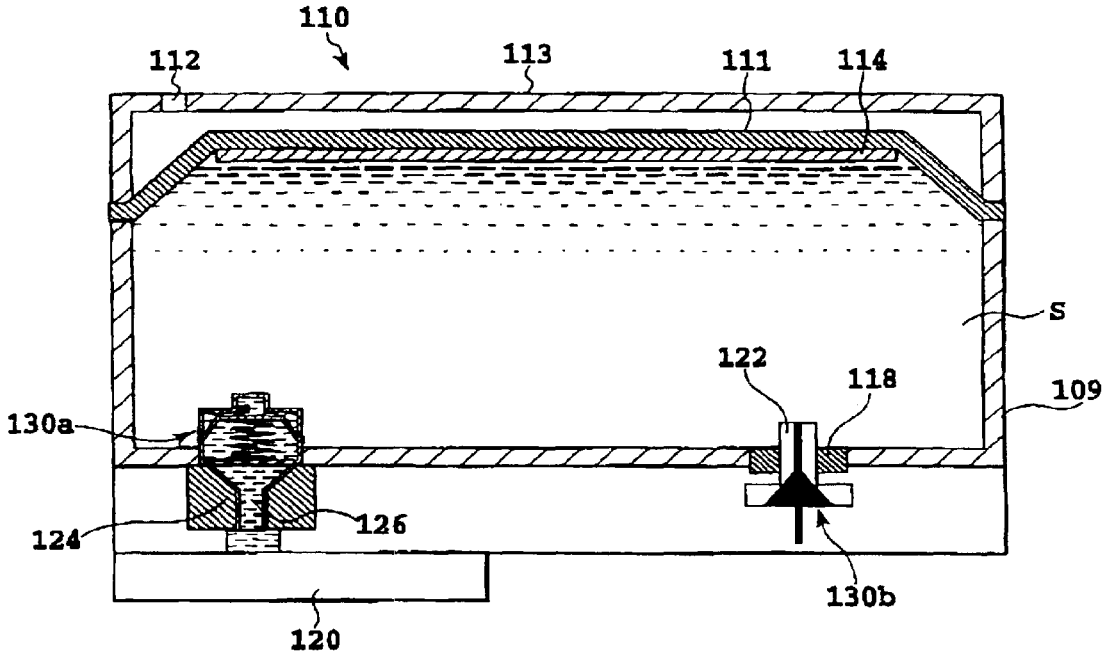
FIG. 9 is a sectional view illustrating the ink tank of a third embodiment.

FIG. 9 is a diagram illustrating a third embodiment of the present invention.

In this embodiment, a one-way valve unit 130*a* for controlling a liquid supply, which is similar to the one-way valve unit 25 shown in FIGS. 1, 2A, 2B, and a one-way valve unit 130*b* for controlling a liquid supply, which is similar to the one-way valve unit 130 for introducing gas or liquid shown in FIGS. 5–8, are provided in the liquid container.

This embodiment has a one-way valve unit 130*a* for controlling a liquid supply equipped with a hollow needle 126 in the liquid supply unit of the ink tank 110. The gas (or liquid) introduction unit of the ink tank 110 is closed by a rubber plug 118 which isolates the containing space S from the outside. On the other hand, the print head 120 has a rubber plug (rubber lid) 124 in the position corresponding to the liquid supply unit of the ink tank 110 to isolate the ink supply passage in the print head 120 from the outside. The print head also has a one-way valve unit 130*b* for controlling a liquid supply equipped with a hollow needle 122 in the position corresponding to the rubber plug 118 of the ink tank 110. The hollow needle 126 of the one-way valve unit 130*a* for controlling a liquid supply and the hollow needle 122 of the one-way valve unit 130*b* for controlling a liquid supply are inserted in the corresponding rubber plugs 124 and 118, respectively. Then an inkjet cartridge is constituted as shown in FIG. 9. Ink is introduced from the containing space S to the print head 120, and air is introduced from the outside into the containing space S, as described in the first and second embodiments.

In this configuration, the one-way valve 130*a* for controlling a liquid supply controls the negative pressure applied to the head 120, while the one-way valve 130*b* for controlling a liquid supply introduces air (outside air). Then almost all the ink in the ink tank 110 can be consumed regardless of the properties of the movable unit 111. Furthermore, because the two one-way valves operate in combination, the negative pressure applied to the head during valve operation is distributed to ripple pressure. As a result, the negative pressure comes to less fluctuate, and the printing quality is improved.

(Fourth Embodiment)

Figure 10:
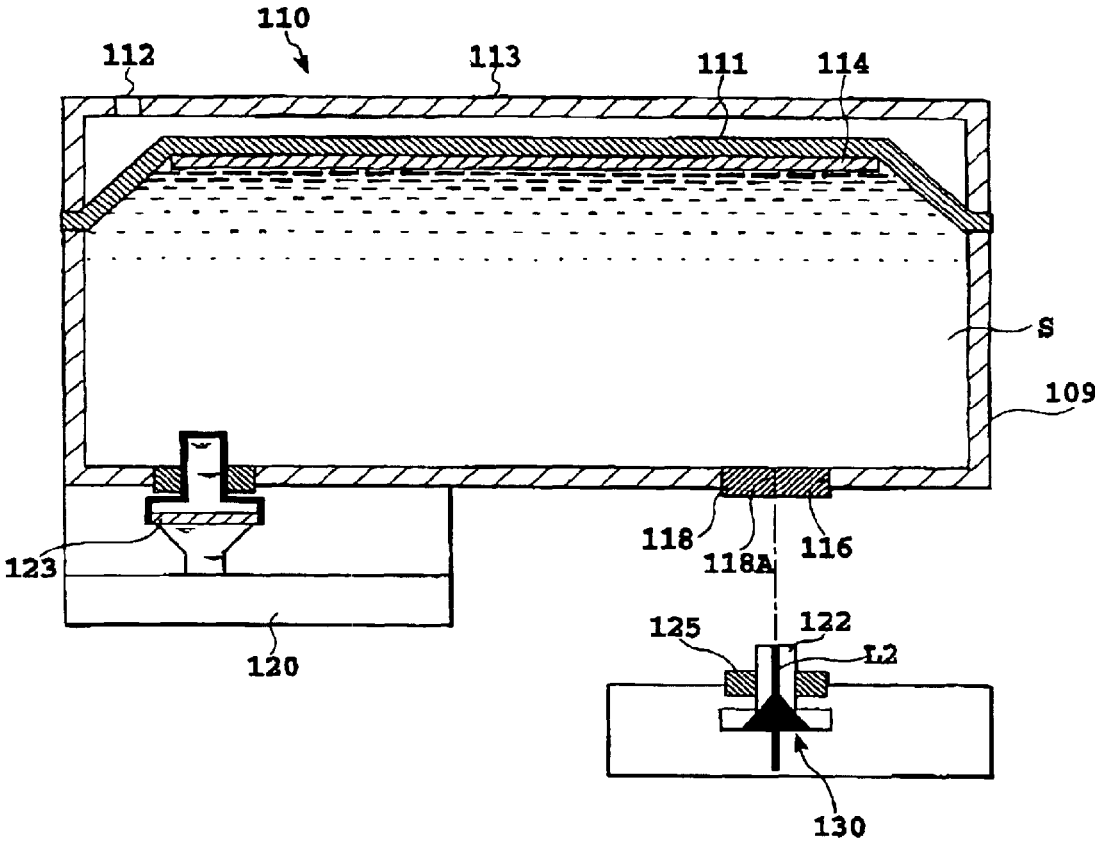
FIG. 10 is a sectional view illustrating the ink tank of a fourth embodiment.

FIG. 10 is a diagram illustrating a fourth embodiment of the present invention.

In this embodiment, the ink tank 110 and the print head 120 are inseparably combined with each other, while the ink tank 110 and the one-way valve unit 130 are separably combined to provide a detachable inkjet cartridge for the inkjet print apparatus. Then it is possible to selectively replace the combination of the ink tank 110 and the print head 120, only the one-way valve unit 130, or the whole inkjet cartridge.

(Fifth Embodiment)

Figure 11:
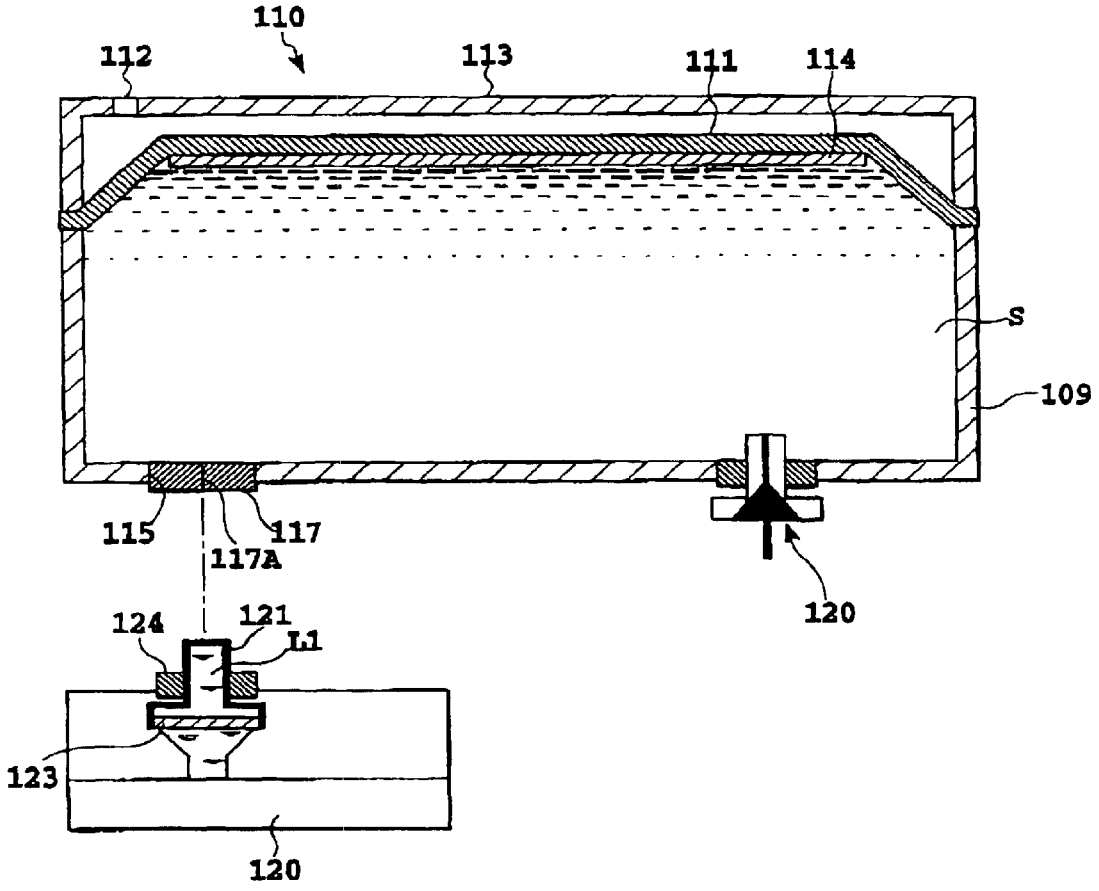
FIG. 11 is a sectional view illustrating the ink tank of a fifth embodiment.

FIG. 11 is a diagram illustrating a fifth embodiment of the present invention.

In this embodiment, the ink tank 110 and the one-way valve unit 130 are inseparably combined together, while the ink tank 110 and the print head 120 are separably combined to provide a detachable inkjet cartridge for the inkjet print apparatus. Thus it is possible to selectively replace the combination of the ink tank 110 and the one-way valve unit 130, only the print head 120, or the whole inkjet cartridge. The filter 123 may be installed in the ink tank 110.

The ink tank 110 and the print head 120 may be separably combined, and the ink tank 110 and the one-way valve unit 130 may also be separably combined together. Then it is possible to selectively replace only the ink tank 110, print head 120 or one-way valve 130. In this case, the filter 123 may be installed in the ink tank 110.

(Other Embodiments)

The ink tank 110 may have the positions for the ink supply opening 115 and the communicating opening 116 in advance and then the ink supply opening 115 and communicating opening 116 can be formed when the ink tank 110 is used. The ink tank 110 may be whatever if it can hold ink and may not hold ink before use.

The present invention can be widely applied to various recording systems, systems that provide various liquids such as drinking water and liquid seasonings, and those that provide medical reagents for use in diverse application areas.

(Manufacturing Method for the Liquid Container)

Figure 12A:
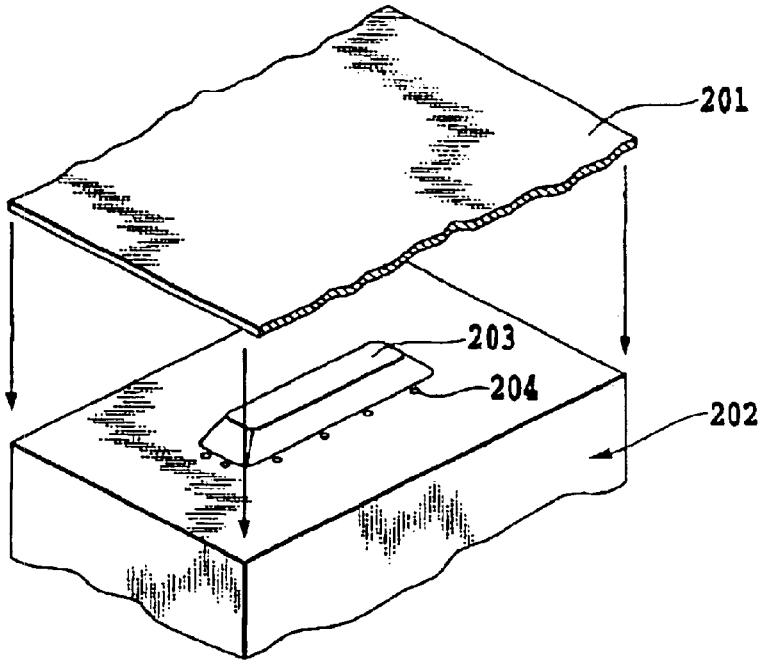
FIGS. 12A to 12C are diagrams illustrating the manufacturing method for the convex movable unit of the present invention.
Figure 12B:
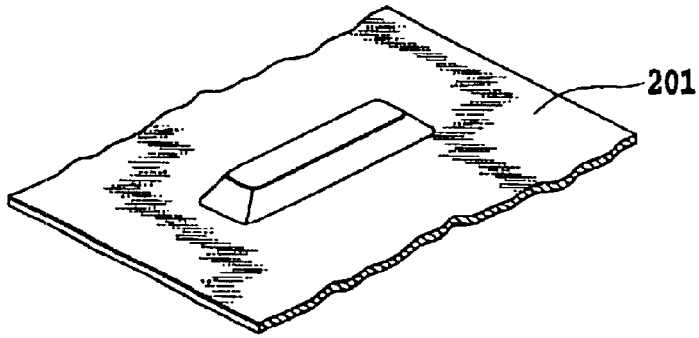
Figure 12C:
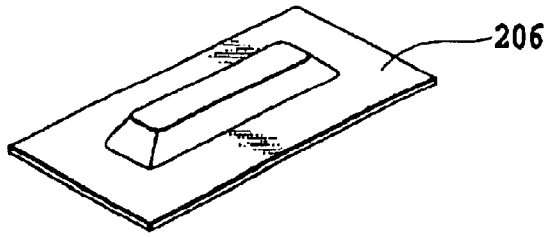

FIGS. 12A to 12C illustrate the steps for forming the tank sheet (flexible film) 206, which will become the movable unit of the ink tank serving as a liquid container, into a convex shape.

The sheet material 201 for the tank sheet 206 is a large sheet made from raw materials. The sheet material 201 decides a major part of the ink tank performance. The sheet material 201 needs to have a low gas (air) and liquid (ink) permeability, while being flexible and durable enough to endure repeated deformations. Preferable materials for the sheet material include synthetic resins such as PP, PE, PVDC, EVOH and nylon. Compound materials onto which aluminum and silica, for example, have been evaporated may also be used. Such materials may be layered for use; particularly, if PP or PE which is highly resistant to chemical agents is layered together with PVDC which has a very low gas/steam permeability, an excellent ink tank is provided. The thickness of the sheet material 201 is preferably 10–100 $\mu$m in the light of required flexibility and durability.

As shown in FIG. 12A, such a sheet material 201 is formed into a convex shape by a mold 202 having a convex part 203, vacuum holes 204 and a temperature control mechanism (not shown). Specifically, the sheet material 201 is sucked onto the vacuum holes 204 and then formed into a convex shape fitting the convex part 203, receiving heat provided by the mold 202. The sheet material 201 is formed into a convex shape as shown in FIG. 12B and then cut into a tank sheet 206 of a predetermined size as shown in FIG. 12C. The tank sheet is large enough to be served in the following manufacture steps, and its size is determined according to the capacity of the ink tank that will hold ink in it and other factors.

(Other Examples of the Structure of the Liquid Container)

Figure 13:
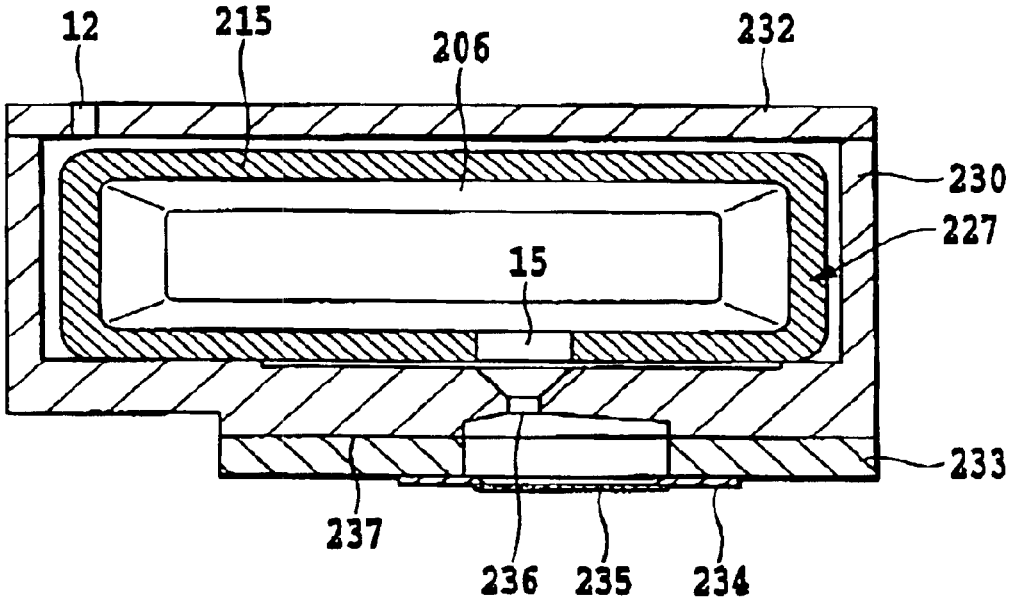
FIG. 13 is a schematic sectional view of the ink container unit of a seventh embodiment of the present invention.

FIG. 13 is a sectional view of the ink tank equipped with an ink container unit in the first embodiment manufactured using a convex tank sheet formed in the above manner.

The ink tank 227 has a closed structure in which a tank sheet 206 is mounted on each of the openings on both sides of the square frame 215. The frame 215 has an ink outlet 15 that serves as a liquid ejection unit leading to the inside of the ink tank 227. The ink held in the ink tank 227 is sent via a filter 237 to the ink guide 236 formed in the housing 230 constituting the ink container unit. The ink is then sent to a head chip 233 via a one-way valve unit 25 (not shown). The one-way valve unit 25 is installed uniformly in either the ink container unit 230 or the head chip 233, as described in the first embodiment shown in FIGS. 1–4.

The head chip 233 in this embodiment has a heater board 234 to constitute the inkjet print head 20. The heater board 234 has an orifice 235 that works as an ink ejection passage and ejection port, and a thermoelectric converter (heater) to eject ink sent from the ink tank 227. The ink tank 227 has the housing 230 having an air-through hole 12 leading to the air, which is the only way to the outside, and protects the tank sheet 106 from external forces, constituting the ink container unit.

Note that the ink container unit may have either a single or more than one ink tank.

Figure 14:
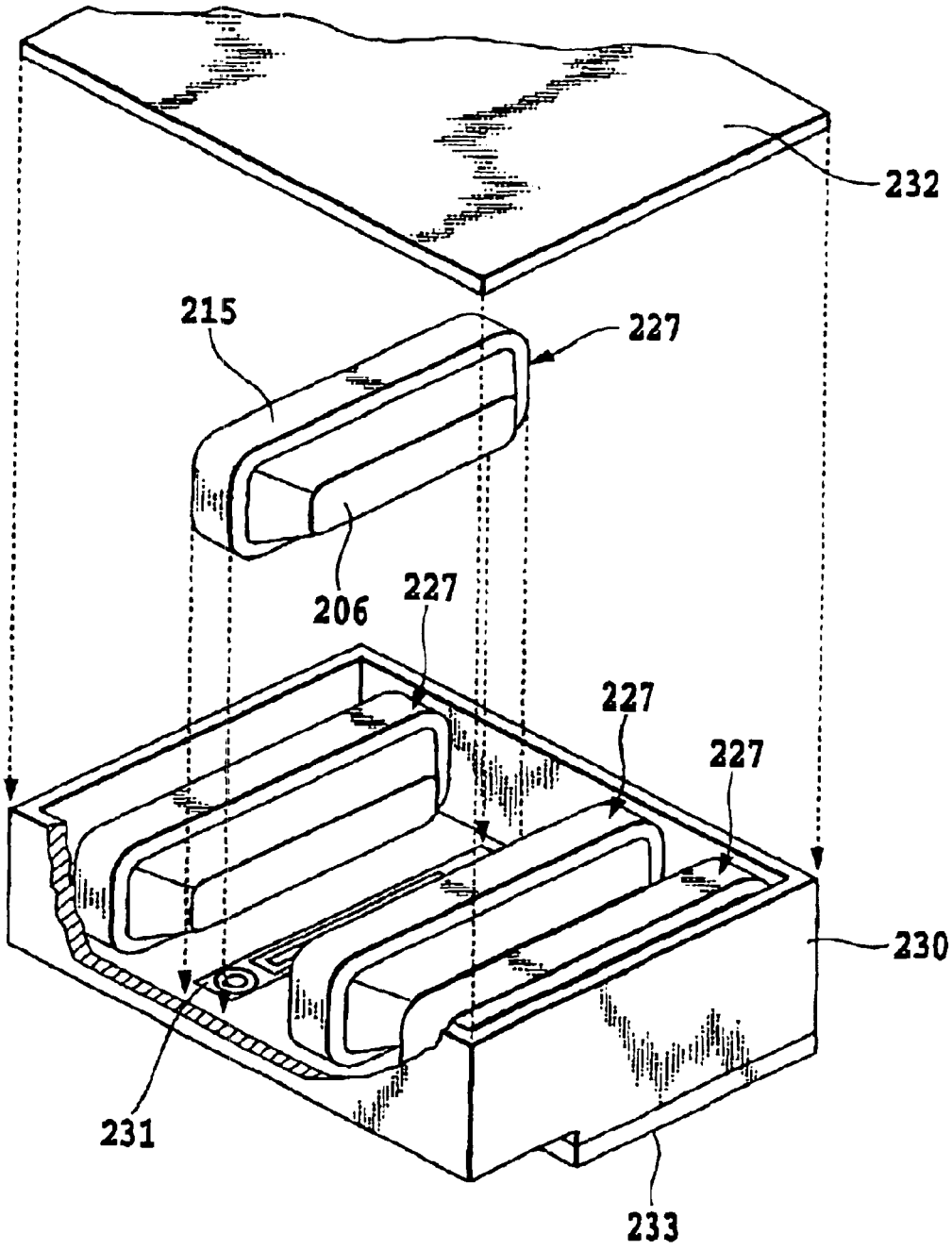
FIG. 14 is a schematic perspective view of the ink container unit of an eighth embodiment of the present invention.

FIG. 14 illustrates the structure of the ink container unit. A plurality of ink tanks 227 are installed in the housing 230 serving as the ink tank holder. The ink tanks 227 are attached to the mounting beds 231 by soldering and adhesion. Also the ink tanks 227 is combined with the head chip 233 via the one-way valve unit 25 to send the ink held in the ink tank 227. Later, a lid 232 having a vent 12 leading to the air is attached to the opening of the housing 230 by soldering or adhesion to render the housing 230 a substantially sealed space. This embodiment is described in relation with the first embodiment, but can be applied to the second-fifth embodiments.

EXAMPLES OF THE STRUCTURE OF THE INKJET PRINT APPARATUS

Figure 15:
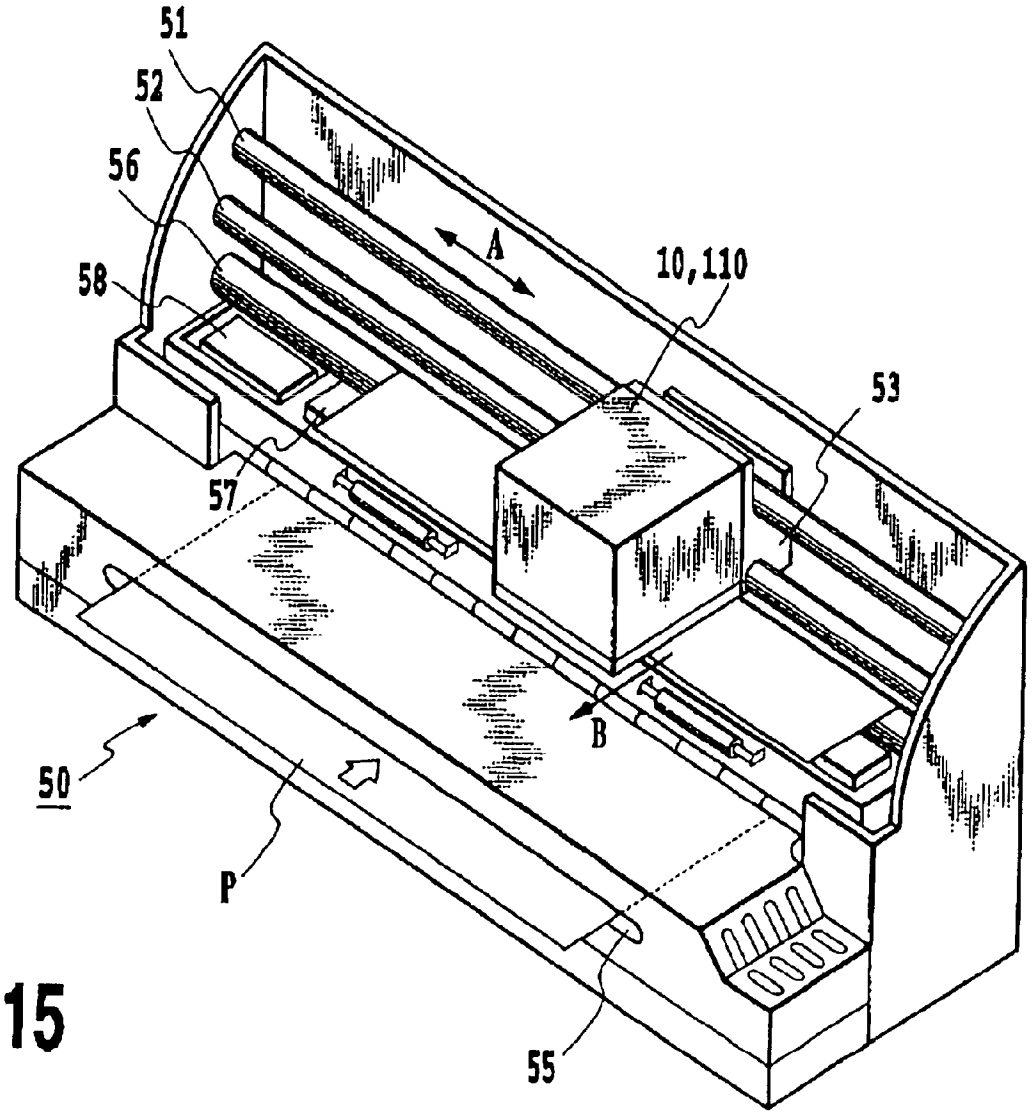
FIG. 15 is a diagram illustrating an example of the structure of the inkjet print apparatus serving as a liquid using apparatus to which the present invention is applicable.

FIG. 15 is a diagram illustrating an example of the inkjet print apparatus that is a liquid using apparatus to which the present invention can be applied.

Print apparatus 50 of the present embodiment is an inkjet print apparatus of the serial-scan type, and a carriage 53 moves along the guide shafts 51, 52 in the main scanning direction indicated by arrow A. The carriage 53 shuttles in the main scanning direction, driven by a driving force transmission mechanism composed of, for example, a carriage motor and a motor torque transmission belt. The carriage 53 is equipped with inkjet print heads 20, 120 (not shown in FIG. 15), and ink tanks 10, 110 that provide ink to the inkjet print heads 20, 120, respectively. The inkjet print heads 20, 120 and the ink tanks 10, 110 may have the structures described in the above embodiments to constitute an inkjet cartridge. A paper sheet P or a printing medium is inserted in an inlet 55 on the front face of the system, and transported in the sub-scanning direction indicated by arrow B by a feeder roller 56 after its transport direction has been reversed. The recording system 50 moves the print heads 20, 120 in the main scanning direction, and repeats the recording operation of ejecting ink onto the target area on the paper sheet P on a platen 57 and the transport operation of feeding the paper sheet P as much as the printing width in the sub-scanning direction, so as to print images sequentially on the paper sheet P.

The inkjet print heads 20, 120 may use thermal energy provided by a thermoelectric converter as the energy used in ejecting ink. In such a case, the heat generated by the thermoelectric converter produces film boiling from the ink and the energy of generated bubbles allows ink to be ejected out of the ink ejection port. The method of ejecting ink from the inkjet print heads 20, 120 is not limited to the above method using a thermoelectric converter. For example, piezoelectric devices may also be used to eject ink.

A recovery unit (recovery means) 58 is mounted at the left end of the movable region of the carriage 53 in FIG. 8, opposite to a face on which the ink ejection ports of the inkjet print heads 20, 120 are formed. The recovery unit 58 has a cap that caps the ink ejection ports of the print heads 20, 120 and a suction pump that can generates a negative pressure inside the cap. By introducing a negative pressure in the cap covering the ink ejection ports, the recovery unit sucks ink from the ink nozzles and maintains a good ink ejecting condition for the inkjet print heads 20, 120 (suction recovery). Alternatively, it is possible to maintain a good ink ejecting condition for the inkjet print heads 20, 120 by ejecting ink (ink not involved in recording) from the ink nozzles toward the cap (ejection recovery).

The print apparatus of the present embodiment supply ink to the inkjet print heads 20, 120 from the ink tanks 10, 110 installed in the carriage 53 together with the inkjet print heads 20, 120.

In the liquid supply system including a liquid container and a liquid using apparatus, the present invention having a one-way valve unit capable of controlling pressure can supply liquid to the liquid using apparatus under a highly stabilized, negative pressure. Since the liquid container itself does not need to maintain a negative pressure, its shape is flexibly designed and its capacity is effectively utilized. Furthermore, since there is no need to apply a large pressure to the flexible, large face of the liquid container, its durability is enhanced. The invention thereby provides great merits in terms of performance and cost.

In addition, since the invention uses a one-way valve unit to prevent liquid leakage from the sealed space where a liquid such as ink is held, while allowing air or liquid to be introduced from the outside into the sealed space, it is possible to use up the liquid in the sealed space almost completely. Since the liquid in the sealed space does not leak out through the one-way valve, the liquid container such as the ink tank may take any attitude during use. Thus it can be preferably used in mobile printers of which attitudes easily change during-use and carry.

The present invention has been described in detail with respect to preferred embodiments, and it will now be apparent from the foregoing to those skilled in the art that changes and modifications may be made without departing from the invention in its broader aspects, and it is the intention, therefore, in the appended claims to cover all such changes and modifications as fall within the true spirit of the invention.

What is claimed is:

1. A liquid supply system comprising:

an ink tank including a movable unit which is deformable and at least a part of which is made of a flexible material, said ink tank further including an ink supply unit for supplying ink to the outside and an air through hole for communicating with ambient air, wherein an interior of said ink tank forms a substantially sealed space except for said ink supply unit and contains ink within the sealed space; and an ink jet head on which the ink tank is removably mounted and which receives ink supplied from said ink supply unit;

wherein said ink jet head is provided with a one-way valve operable to allow the ink to pass therethrough from said sealed space while prohibiting liquid or gas passing therethrough into said sealed space when ink is supplied through said ink supply unit.

2. The liquid supply system as claimed in claim 1, wherein said one-way valve supplies ink from said sealed space to the outside when a pressure difference between the sealed space and the outside exceeds a predetermined value.

3. A liquid supply system comprising:

an ink tank including a movable unit which is deformable and at least a part of which is made of a flexible material, said ink tank further including an ink supply unit for supplying ink to the outside, a gas introduction unit for introducing gas from the outside, and an air through hole for communication with ambient air, wherein an interior of the ink tank forms a substantially sealed space except for said ink supply unit and said gas introduction unit and contains ink within the sealed space; and an ink jet head on which the ink tank is removably mounted and which receives ink supplied from said ink supply unit;

wherein said ink jet head is provided with an ink supply joint unit which joins with said supply unit to supply ink from said ink supply unit to said ink jet head, and a one-way valve operable to allow gas to be introduced through a connection with the gas introduction unit while prohibiting liquid or gas to be discharged from said sealed space.

4. The liquid system as claimed in claim 3, wherein said one-way valve for controlling a liquid supply introduces gas from the outside to said sealed space when a pressure difference between the sealed space and the outside exceeds a predetermined value.

5. An ink tank comprising a movable unit which is deformable and at least a part of which is made of a flexible material, an ink supply unit for supplying ink to the outside, and a gas introduction unit for introducing gas from the outside, wherein an interior of the ink tank forms a substantially sealed space except for said ink supply unit and said gas introduction unit so as to retain liquid within said sealed space, wherein said ink supply unit is provided with a first one-way valve operable to allow ink to pass therethrough from said sealed space while prohibiting ink or gas to pass therethrough into said sealed space; and wherein said gas introduction unit is detachably provided with a second one-way valve operable to allow gas to be introduced from the outside to said sealed space while prohibiting gas or ink to be discharged from said sealed space to the outside, when supplying ink from said sealed space to the outside.

6. An ink tank as claimed in claim 5, wherein said first one-way valve supplies ink from said sealed space to the outside when a pressure difference between said sealed space and the outside exceeds a predetermined value.

* * * * *